US006129466A

United States Patent [19]

Suzuki

[11] Patent Number: 6,129,466

[45] Date of Patent: Oct. 10, 2000

[54] TAPE PRINTER CAPABLE OF COMBINING PLURAL DOCUMENTS ON A TAPE WITH ADVANCED CUTTING INSTRUCTIONS FOR INTELLIGENT DOCUMENT PRESENTATION

[75] Inventor: Katsuyoshi Suzuki, Akiruno, Japan

[73] Assignee: Casio Computer Co., Ltd., Tokyo, Japan

[21] Appl. No.: 09/280,208

[22] Filed: Mar. 29, 1999

[30] Foreign Application Priority Data

Mar. 31, 1998 [JP] Japan ..... 10-086415

[51] Int. Cl.[7] ..... B41J 11/26

[52] U.S. Cl. ..... 400/615.2; 400/621

[58] Field of Search ..... 400/615.2, 621

[56] References Cited

U.S. PATENT DOCUMENTS 5,222,818 6/1993 Akiyama et al. ..... 400/61
5,741,082 4/1998 Toya ..... 400/615.2

FOREIGN PATENT DOCUMENTS 0 429 873 A2 6/1991 European Pat. Off. .
0 475 625 A2 3/1992 European Pat. Off. .
0 475 767 A2 3/1992 European Pat. Off. .
0 711 670 A2 5/1996 European Pat. Off. .
0 764 541 A2 3/1997 European Pat. Off. .
0947339 A2 3/1999 European Pat. Off. .
0764541 A2 10/1999 European Pat. Off. .
07156477 6/1995 Japan .

*Primary Examiner*—John S. Hilten
*Assistant Examiner*—Charles H. Nolan
*Attorney, Agent, or Firm*—Frishauf, Holtz, Goodman, Langer & Chick, P.C.

[57] ABSTRACT

When a desired plurality of document data are selected from a recorded plurality of document data and read into a text memory, the selected plurality of document data are combined into a document data string, and cut instruction data is added between any two adjacent document data. Printing lengths of a tape are calculated for the respective document data sectioned by the cut instruction data, so that positions where the tape is cut are calculated and then stored in a cut position memory. In connection with printing of the document string developed into a print data memory from the text memory, a cut instruction signal is output and the tape is cut each time the number of motor driving steps for tape carriage matches a respective one of the cut positions.

12 Claims, 12 Drawing Sheets

42b (RECORDED DOCUMENT MEMORY)

| AREA NO. | DOCUMENT DATA | FORM DATA | | |
|---|---|---|---|---|
| 1 | a b c d | $S_1$ | $P_1$ | $M_1$ |
| 2 | e f g | $S_2$ | $P_2$ | $M_2$ |
| 3 | h i | $S_3$ | $P_3$ | $M_3$ |
| 4 | j k l | $S_4$ | $P_4$ | $M_4$ |
| 5 | m n o p q | $S_5$ | $P_5$ | $M_5$ |
| 6 | r s t u v | $S_6$ | $P_6$ | $M_6$ |
| 7 | x y z | $S_7$ | $P_7$ | $M_7$ |

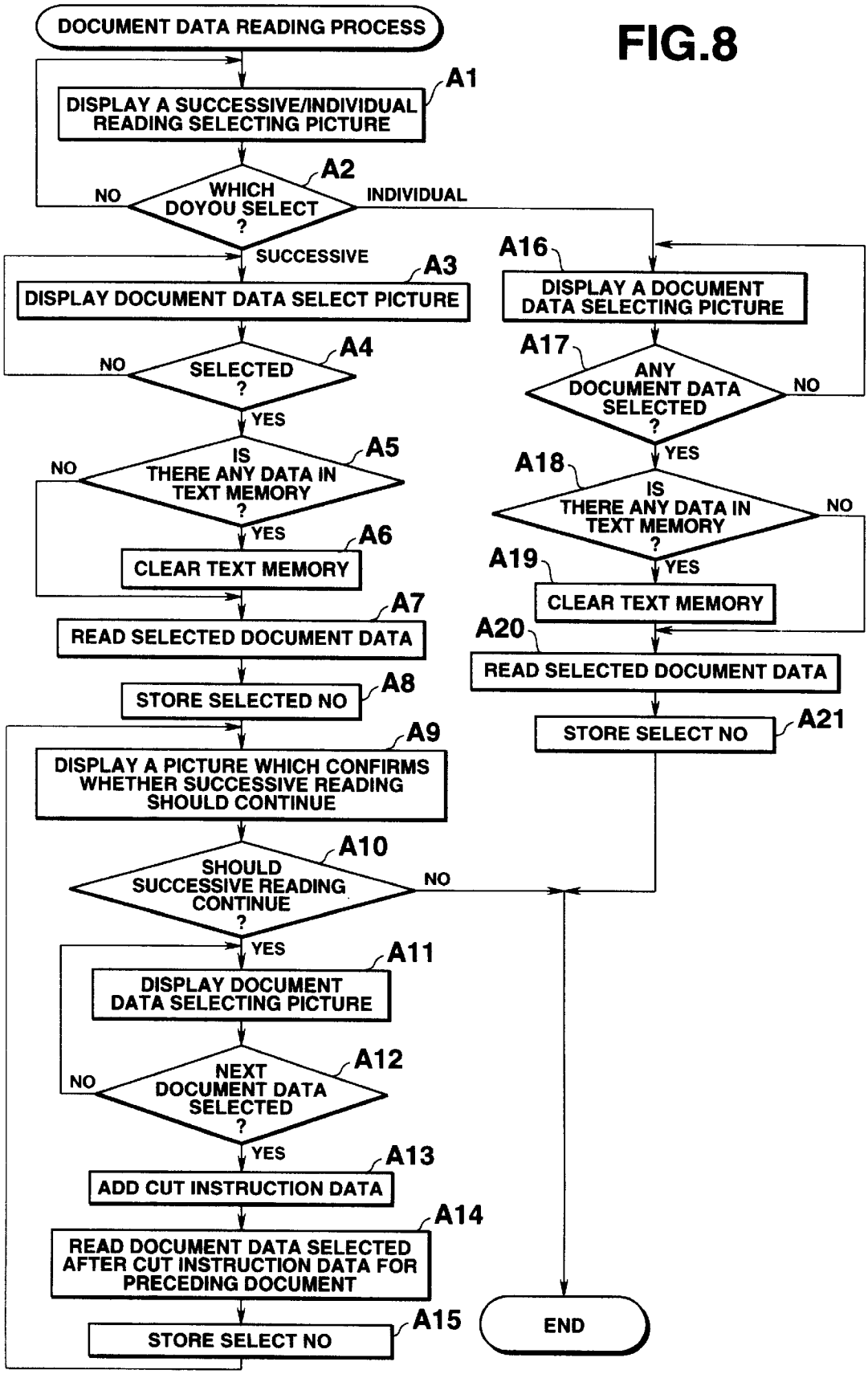
FIG.8
DOCUMENT DATA READING PROCESS
A1
DISPLAY A SUCCESSIVE/INDIVIDUAL READING SELECTING PICTURE
A2
WHICH DOYOU SELECT ?
NO
INDIVIDUAL
SUCCESSIVE
A3
DISPLAY DOCUMENT DATA SELECT PICTURE
A4
SELECTED ?
NO
YES
A5
IS THERE ANY DATA IN TEXT MEMORY ?
NO
YES
A6
CLEAR TEXT MEMORY
A7
READ SELECTED DOCUMENT DATA
A8
STORE SELECTED NO
A9
DISPLAY A PICTURE WHICH CONFIRMS WHETHER SUCCESSIVE READING SHOULD CONTINUE
A10
SHOULD SUCCESSIVE READING CONTINUE ?
NO
YES
A11
DISPLAY DOCUMENT DATA SELECTING PICTURE
A12
NEXT DOCUMENT DATA SELECTED ?
NO
YES
A13
ADD CUT INSTRUCTION DATA
A14
READ DOCUMENT DATA SELECTED AFTER CUT INSTRUCTION DATA FOR PRECEDING DOCUMENT
A15
STORE SELECT NO
A16
DISPLAY A DOCUMENT DATA SELECTING PICTURE
A17
ANY DOCUMENT DATA SELECTED ?
NO
YES
A18
IS THERE ANY DATA IN TEXT MEMORY ?
NO
YES
A19
CLEAR TEXT MEMORY
A20
READ SELECTED DOCUMENT DATA
A21
STORE SELECT NO
END

FIG.15

42b (RECORDED DOCUMENT MEMORY)

| AREA NO. | DOCUMENT DATA | FORM DATA | | |
|---|---|---|---|---|
| 1 | a b c d [C] | $S_1$ | $P_1$ | $M_1$ |
| 2 | e f g [C] | $S_2$ | $P_2$ | $M_2$ |
| 3 | h i [C] | $S_3$ | $P_3$ | $M_3$ |
| 4 | j k l [C] | $S_4$ | $P_4$ | $M_4$ |
| 5 | m n o p q [C] | $S_5$ | $P_5$ | $M_5$ |
| 6 | r s t u v [C] | $S_6$ | $P_6$ | $M_6$ |
| 7 | x y z | $S_7$ | $P_7$ | $M_7$ |

TAPE PRINTER CAPABLE OF COMBINING PLURAL DOCUMENTS ON A TAPE WITH ADVANCED CUTTING INSTRUCTIONS FOR INTELLIGENT DOCUMENT PRESENTATION

BACKGROUND OF THE INVENTION

The present invention relates to tape printers which print document data of character strings on a tape as a printing medium to produce a label, and more particularly to a tape printer which reads out a plurality of document data stored in a memory and then prints the plurality of document data on a tape to produce a plurality of labels.

Conventionally, there are known tape printers which produce title labels to be stuck to audio or video cassettes and other various labels to be stuck to other articles.

In each such tape printer, a plurality of document data of a character string input from a keyboard are stored in a memory, desired document data is read from the memory as requested and printed on a tape by a thermal head, the printed tape portion is discharged through a tape discharge port to the outside, and the discharged printed tape portion is then cut by a manually or automatically driven cutter disposed between the thermal head and the tape discharge port to thereby produce a label.

When a plurality of labels are produced by reading a desired plurality of document data from among the plurality of document data stored in the memory and printing the read plurality of document data on the tape, one-document data is first read from the memory area and printed on the tape in accordance with the respective user's instructions. Then, the printed tape portion is cut by the cutter to produce a label. This process is repeated on the other respective document data to be printed.

As described above, in the conventional tape printer, each time one label is produced, and then one-document data is read from the memory and printed, and then the printed tape potion is cut. Thus, the label production is troublesome for the user, and much time is taken for production of the plurality of labels.

Generally, in the tape printer, the tape carrying mechanism which carries the tape in printing is capable of carrying the tape in one direction, but not in the reverse direction. When a label is produced by the tape printer, a margin of a predetermined length is provided at each of the leading and trailing ends of the document (character string) to be printed. Since the tape carrying mechanism only can carry the tape in one direction and not in the reverse direction, the tape is required to be cut at its leading end portion during printing to ensure a margin set at the leading end of the character string when the set margin is shorter than the distance between the thermal head and the cutter.

As described above, when a plurality of labels are produced successively based on the plurality of document data stored in the memory in the conventional tape printer, the tape is required to be cut at its leading end portion to ensure a margin at the leading end of the printed character string each time one label is produced, which leads to wasteful consumption of the tape.

SUMMARY OF THE INVENTION

It is therefore an object of the present invention to provide a tape printer which when a plurality of labels are successively produced based on a plurality of document data stored in the memory, simplifies the user's operation, produces a plurality of labels in a short time, and eliminates wasteful consumption of the tape.

In order to achieve the above object, according to one aspect of the present invention, there is provided a tape printer comprising input means for inputting document data of a character string, storage means having an area for recording a plurality of document data of a character string input by the input means, recording means for recording in the area of the storage means the plurality of document data input by the input means, printing means for printing lengthwise on a tape as a printing medium a plurality of documents corresponding to the plurality of document data recorded in the area of the storage means by the recording means, cutting means for cutting the tape, and carrying means for carrying the tape to the printing means and the cutting means, the printer comprising;

reading means for reading a desired plurality of document data from among the plurality of document data recorded in the area of the storage means;

data combining means for combining into a document data string the desired plurality of document data read by the reading means;

cut data instruction adding means for adding cut instruction data which cuts the tape to between the respective document data of the desired plurality combined by the data combining means to section the respective document data;

calculating means for calculating the respective printing lengths of the tape for the respective document data of the document data string sectioned by the cut instruction data to obtain the corresponding tape cutting positions; and control means for controlling the printing means and carrying means to print on the tape a document string corresponding to the document data string to which the desired plurality of document data are combined by the data combining means, during carriage of the tape, and to discontinue the printing of the document data on the tape and the carriage of the tape each time the cutting position of the tape calculated by the calculating means is carried to the position of the cutting means, and to output to the cutting means a cut instruction signal to cut the tape.

First, a desired plurality of document data are read from among the plurality of document data recorded in the area of the storage means. The read desired plurality of document data are then combined into a document data string. The cut instruction data which cuts the tape is added between the respective document data of the desired plurality to section the respective document data. The respective printing lengths of the tape for the respective document data of the document data string sectioned by the cut instruction data are calculated to obtain the corresponding tape cutting positions. When a document string corresponding to the document data string is printed on the tape, the printing of the document data on the tape and the carriage of the tape are discontinued each time the calculated cutting position of the tape is carried to the position of the cutting means, and the cut instruction signal to cut the tape is output.

Thus, according to the particular tape printer, when a plurality of labels are produced on the basis of the document data recorded in the memory, the plurality of document data are read from the storage means and the tape printer is instructed to print the plurality of document data. In response to this operation, the plurality of document data are sequentially printed on the tape and when the respective tape portions have been printed, the printed tape portions are cut away to thereby produce a corresponding plurality of labels automatically. Thus, the user's operation is simplified and the time required for producing the plurality of labels is reduced. No tape cutting is required for setting a margin each time one label is produced, so that wasteful consumption of the tape is avoided.

In order to achieve the above object, according to another aspect of the present invention, there is provided a tape printer comprising input means for inputting document data of a character string, storage means having an area for recording a plurality of document data of a character string input by the input means, recording means for recording in the area of the storage means the plurality of document data input by the input means, printing means for printing lengthwise on a tape as a printing medium a plurality of documents corresponding to the plurality of document data recorded in the area of the storage means by the recording means, cutting means for cutting the tape, and carrying means for carrying the tape to the printing means and the cutting means, the printer comprising;

cut instruction data adding means for adding cut instruction data which cut the tape to respective trailing ends of the plurality of document data input by the input means to section the respective document data when the recording means records the input plurality of document data in the area of the storage means;

reading means for reading a desired plurality of document data from among the plurality of document data recorded in the area of the storage means along with the corresponding plurality of cut instruction data added by the cut instruction data adding means;

data combining means for combining through the cut instruction data the desired plurality of document data read by the reading means so as to produce a document data string;

calculating means for calculating the respective printing lengths of the tape for the corresponding document data of the document data string sectioned by the respective cut instruction data to obtain the corresponding tape cutting positions; and control means for controlling the printing means and carrying means to print on the tape a document string corresponding to the document data string produced by the data combining means during carriage of the tape, and to discontinue the printing of the document data on the tape and the carriage of the tape each time the cutting position of the tape calculated by the calculating means is carried to the position of the cutting means to output to the cutting means a cut instruction signal to cut the tape.

The cut instruction data which cut the tape are added to respective trailing ends of the input plurality of document data when the recording means records the input plurality of document data in the area of the storage means. When a desired plurality of document data are read from among the plurality of document data recorded in the area of the storage means, the corresponding plurality of cut instruction data added the respective ends of the desired plurality of document data are also read. In this case, the read desired plurality of document data are combined through the cut instruction data so as to produce a document data string. In response to this operation, the respective printing lengths of the tape for the corresponding document data sectioned by the respective cut instruction data are calculated to obtain the corresponding tape cutting positions. When a document string corresponding to the document data string is printed on the tape, the printing of the document data on the tape and the carriage of the tape are discontinued each time the calculated cutting position of the tape is carried to the position of the cutting means to output the cut instruction signal to cut the tape.

Thus, according to the last-mentioned tape printer, when a plurality of labels are produced on the basis of the document data recorded in the memory, the plurality of document data are read from the storage means and the tape printer is instructed to print the plurality of document data. In response to this operation, the plurality of document data are sequentially printed on the tape and when the respective tape portions have been printed, the printed tape portions are cut away to thereby produce a corresponding plurality of labels automatically. Thus, the user's operation is simplified and the time required for producing the plurality of labels is reduced. No tape cutting is required for setting a margin each time one label is produced, so that wasteful consumption of the tape is avoided.

BRIEF DESCRIPTION OF THE DRAWINGS

FIG. 8 is a flow chart of a recorded document reading process performed by the tape printer;

FIG. 15 illustrates the contents of data stored in the recorded document memory of the RAM involved in a document data recording process performed in another embodiment;

DESCRIPTION OF THE PREFERRED EMBODIMENT

Figure 1:
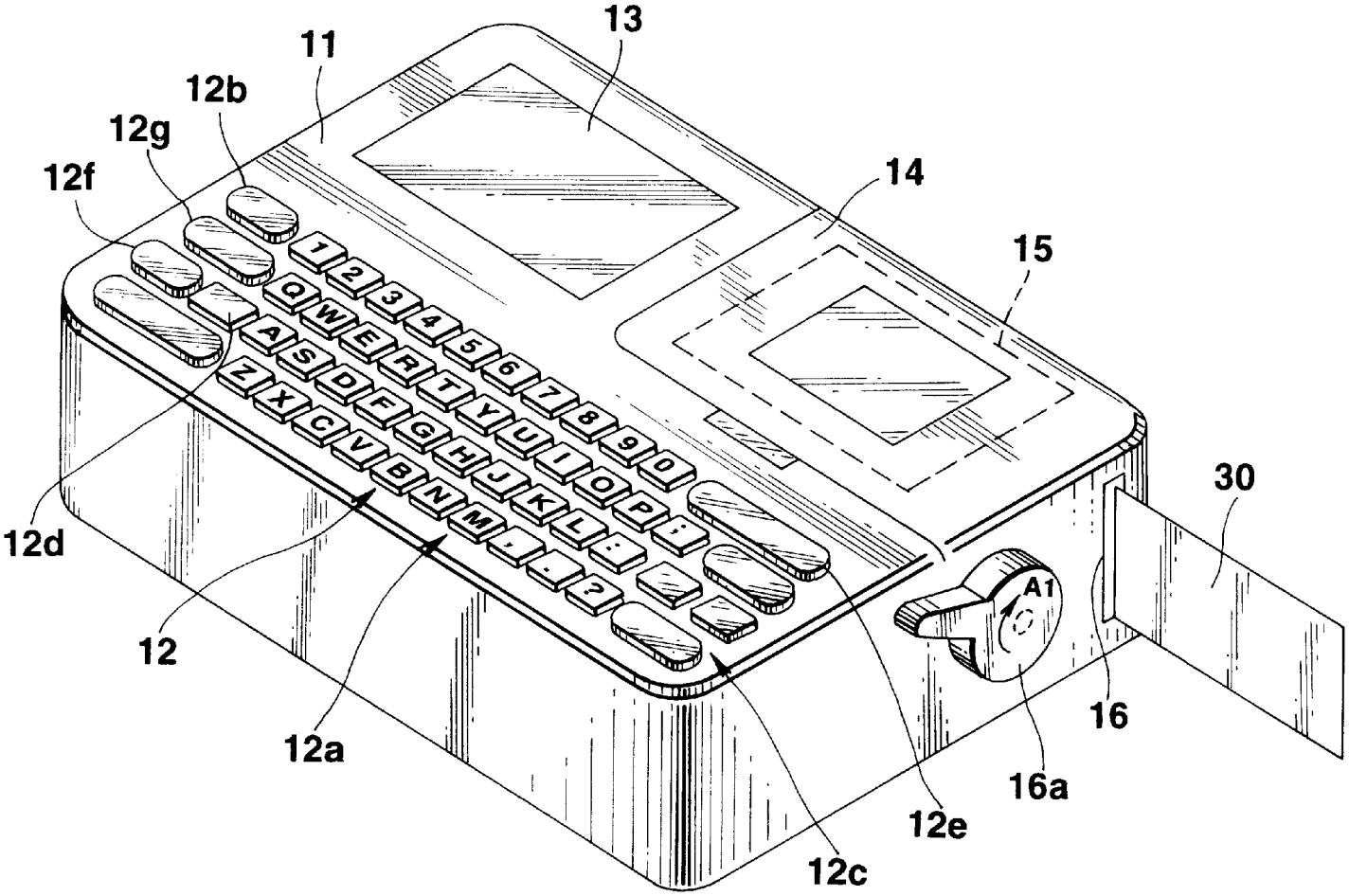
FIG. 1 is a perspective view of an embodiment of a tape printer according to the present invention.

A preferred embodiment of a tape printer according to the present invention will be described next with reference to the drawings. As shown in FIG. 1, the tape printer has on an upper surface of its body 11 a keyboard 12, a liquid crystal display unit 13 and a cassette accommodating section 15 which is covered with an openable cover 14.

The keyboard 12 includes alphanumeric and symbol keys 12*a* which are used to input document data of a characters string, numerals and symbols. In addition, the keyboard 12 also includes a power supply key 12*b,* cursor keys 12*c* which each move a cursor displayed on the liquid crystal display screen 13, a record key 12*d* operated to record input document data, and an enter key 12*e* operated to fix various input/selected data and to instruct the printer to start to fulfill a predetermined function, a read key 12*f* operated to read any one from a stored plurality of document data, and a print key 12*g* operated to print the read document data.

Reference numeral 16 denotes a tape discharge port through which the printed tape portion 30 is discharged to the outside of the printer body 11. Reference numeral 16*a* denotes a cutter operating lever operated to cut the tape discharged from the tape discharge port 16.

Figure 2:
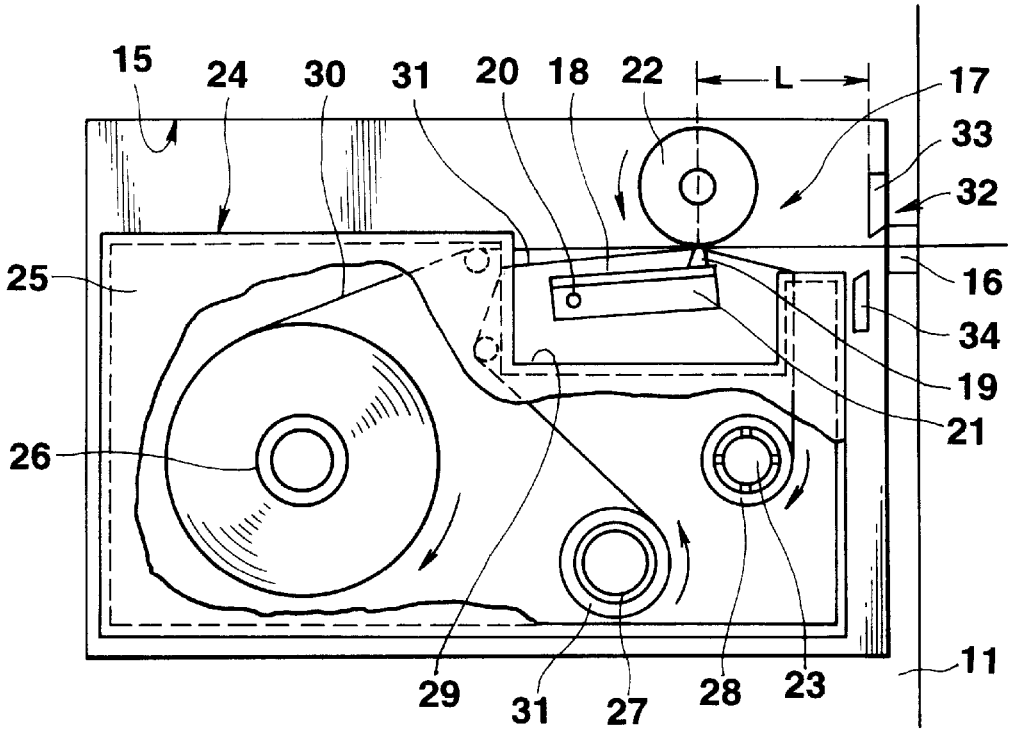
FIG. 2 illustrates the inside of a cassette accommodating section viewed when a cover for the printer is removed away.

FIG. 2 illustrates the inside of the cassette accommodating section 15 viewed when the cover 14 for the printer body 11 is opened. Set within the cassette accommodating section 15 is a tape cassette 24 which contains a tape 30 as a printing medium and a heat transfer ink ribbon 31. Provided within the tape accommodating section are main elements of a printer mechanism 17 such as a thermal head 18 which produces heat based on printing data, a platen roller 22 which is rotated to carry the tape 30 and an ink ribbon 31, and the ink ribbon winding shaft 23 which winds the ink ribbon 31.

The thermal head 18 includes a plurality of heat producing elements 19 arranged in a line across the tape and is attached to a support 21 which is turned around a pivot 20 in connection with opening/closing of the cover 14 by a mechanism (not shown), and assumes a printing position where the plurality of heat producing elements 19 are pressed against the platen roller 22 and a non-printing position where the plurality of heat producing elements 19 are moved away form the platen roller 22.

As shown in FIG. 2, in the printing where the cover 14 is closed, the thermal head 18 presses the tape 30 and ink ribbon 31 against the platen roller 22 whereas when the cover 14 is opened, for example, to exchange the tape cassette 24, the thermal head 18 is moved away from the platen roller 22 so that the tape cassette 24 is exchangeable.

The platen roller 22 is rotated by a driver (not shown) in printing to carry the tape 30 and the ink ribbon 31. The platen roller 22 is arranged so as to rotate only counterclockwise as shown in FIG. 2. Along with the rotation of the platen roller 22, the ink ribbon winding shaft 23 is rotated, as shown in FIG. 2, to wind the ink ribbon 31 heat-transferred by the thermal head 18.

Tape cassette 24 set in the cassette accommodating section 15 includes a cassette case 25, a tape feed reel 26 with a roll of tape 30, an ink ribbon feed reel 27 with a roll of heat transfer ink ribbon 31, and a winding reel 28 which is rotated by the winding drive shaft 23 to wind a used ink ribbon.

The cassette case 25 has a cut 29 in which the thermal head 18 is inserted. The tape 30 and ink ribbon 31 drawn out from the cassette case 25 extends across the cut 29 and pressed by the thermal head 18 against the platen roller 22.

The tape 30 is composed of a synthetic resin sheet which has a printing surface and a back surface coated with an adhesive, and a tape-like paper base pasted removeably on the back of the sheet.

Figure 3:
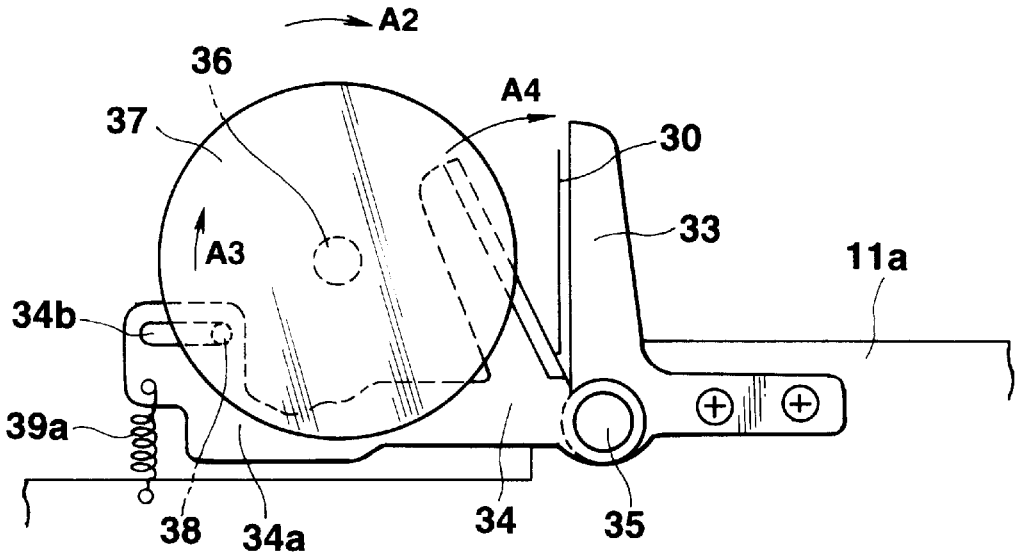
FIG. 3 illustrates a manually operated cutter mechanism provided in the cassette accommodating section.

A cutter mechanism 32 is provided within the cassette accommodating section 15 in the vicinity of the discharge port 16. FIG. 3 illustrates a manually operated cutter mechanism 32 of a scissors type which includes a fixed blade 33 and a movable blade 34. More particularly, the cutter mechanism 32 includes the fixed blade 33 provided to an internal frame 11*a* of the printer body 11, the movable blade 34 provided rotatably around a pivot 35 of the frame 11*a,* an arm 34*a* integral with the movable blade 34 and having a slot 34*b* therein, a cutter operating lever 16*a* having a pivot 36 supported at its center by the body 11 and provided rotatably at an outer side of the printer body 11, a rotating disk 37 fixed to the shaft 36 and rotatable along with the cutter operating lever 16*a* and having a pin 38 engaged in a slot 34*b* in the arm 34*a,* and a return spring 39*a* extending between a free end of the arm 34*a* and the frame 11*a* for returning the movable blade 34 to its reference position.

In FIG. 1, when the user rotates the cutter operating lever 16*a* in the direction of an arrow A1, the rotating disk 37 fixed to the lever shaft 36 is rotated in the direction of an arrow A2 which is identical to the direction A1 in which the lever 16*a* is rotated, as shown in FIG. 3. This causes the pin 38 to move in the direction of an arrow A3, which moves the arm 34*a* and the movable blade 34 toward the fixed blade 33 in the direction of an arrow A4 to thereby cut the tape 30.

When the user releases the cutter operating lever 16*a,* the return spring 39*a* moves the movable blade 34 away from the fixed blade 33 to return the movable blade 34 to its initial position of FIG. 3.

In FIG. 2, reference numeral L denotes the distance between the thermal head 18 and the cutter mechanism 32, that is, the distance between the printing position and the cutting position.

Figure 4:
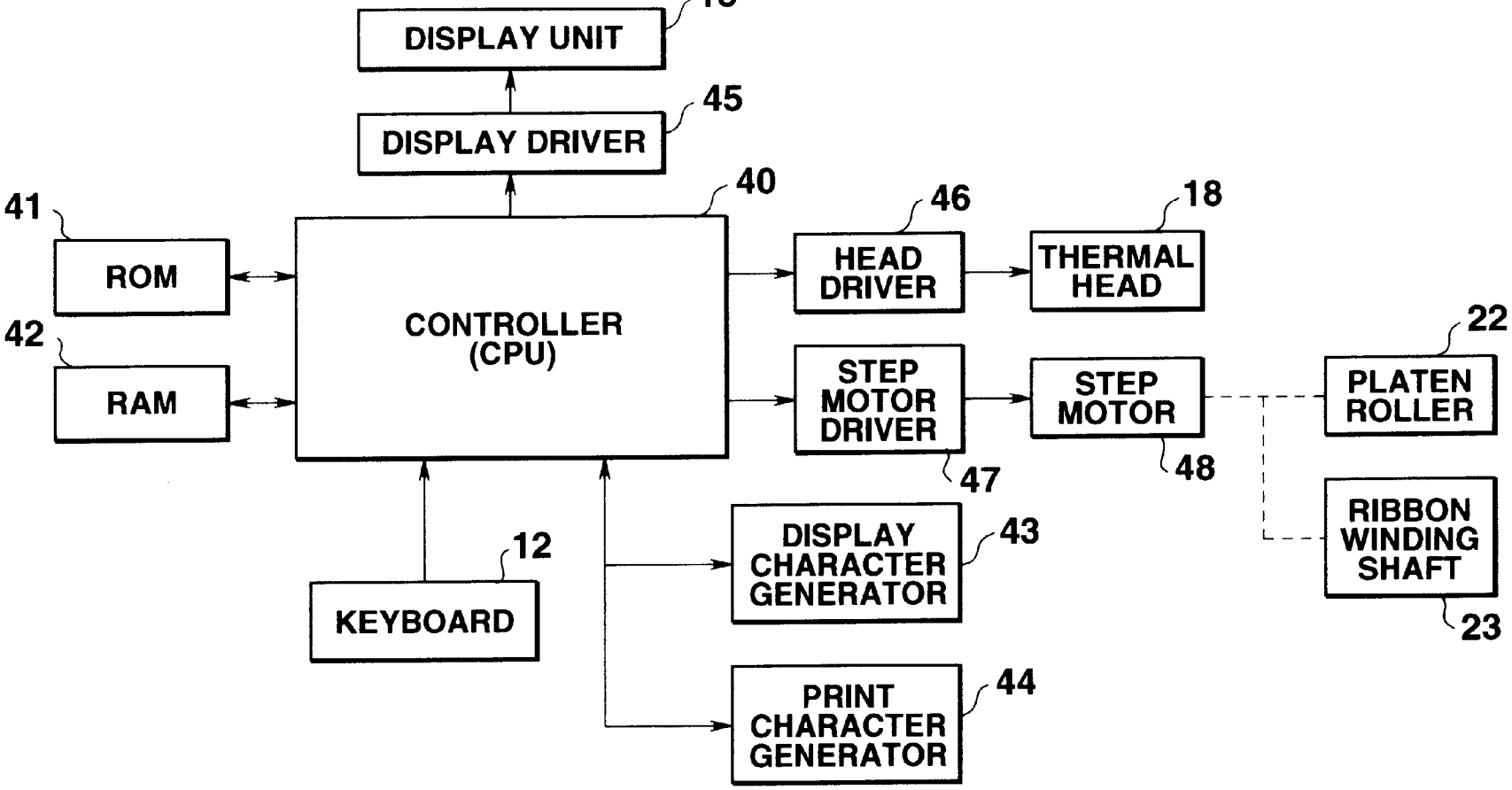
FIG. 4 is a block diagram of an electronic circuit of the tape printer.

FIG. 4 is a block diagram of an electronic circuit of the tape printer, which includes a controller (CPU) 40, which starts up a system program contained in the ROM 41 in accordance with a key-in signal from the keyboard 12 to control the operation of the respective circuit elements.

The ROM 41 further contains various other programs for inputting/displaying character string data, recording input document data of character string data, reading the recorded document data, printing the read document data, etc.

The controller 40 is connected to the keyboard 12, ROM 41, a RAM 42 which stores various input, displayed, recorded, read and printed data, a display character generator 43 which contains data on font patterns to be displayed, a print character generator 44 which contains data on fonts to be printed, and a display driver 45 to display the input character string data on the display unit 13.

The controller 40 is further connected via the head driver 46 to the thermal head 18, and via a step motor driver 47 to a step motor 48 which drives the platen roller 22 and the ribbon winding shaft 23 via a transmission mechanism (not shown).

Figures 5, 6:
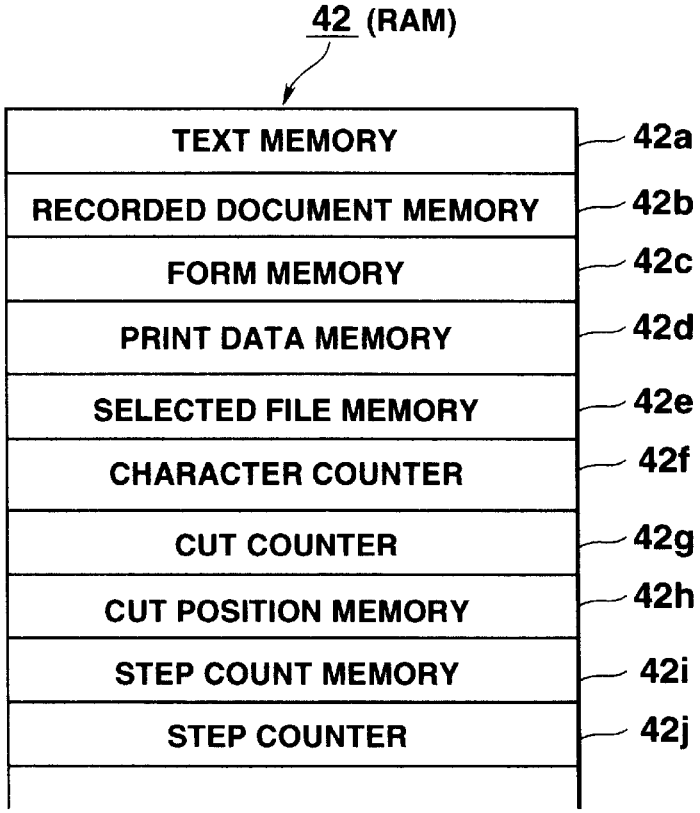
FIG. 5 illustrates the composition of a data memory provided in a RAM of the electronic circuit.
FIG. 6 illustrates the contents of data stored in an recorded document memory provide in the RAM.

FIG. 5 illustrates the contents of the RAM 42 which includes a text memory 42*a,* a recorded document memory 42*b,* a form memory 42*c,* a print data memory 42*d,* a selected file memory 42*e,* a character counter 42*f,* a cut instruction counter 42*g,* a cut position memory 42*h,* a step count memory 42*i,* and a step counter memory 42*j.*

The text memory 42*a* stores the character string data input by the input keys 12*a* of the keyboard 12 in the character string data inputting process and the document data read out from the recorded document memory 42*b* in the document data reading process. The text memory 42*a* stores character string or document data in the form of character codes.

FIG. 6 shows the contents of the recorded document memory 42*b,* which stores at the respective locations document data stored in the text memory 42*a,* and form data such as character sizes S, character spacings P, and leading and trailing margins M for the corresponding input document data stored in the format memory 42*c* as the recording process is performed.

The print data memory 42*d* stores as print data in the form of a bit map a font pattern to which each of the characters of document data stored in the text memory 42*a* in the reading process is converted by the print character generator 44 in the printing process.

The selected file memory 42*e* stores a select No. of the document data read selectively from the recorded document memory 42*b* and stored in the text memory 42*a* in the reading process.

The character counter 42*f* counts the number of characters A of the print data which is read one by one from the text memory 42*a* in the printing process.

The cut counter 42*g* counts the number of tape cut instruction data C contained in the print data read out from the text memory 42*a* in the printing process.

The cut position memory 42*h* stores the number of rotating steps of the step motor 48 which carries the tape 30 stepwise to which data on a tape cut position C0 on the tape where the tape is first cut with a margin M left as the printing process starts, and data on subsequent tape cut positions C1, C2, . . . , Cn where the printed tape portions are sectioned and cut by the respective tape cut instruction data C contained in the print data read out sequentially from the text memory 42*a* are converted.

The initial tape cut position C0 in the printing process is calculated in accordance with the following expression:

$$C0=L-M \qquad \text{Expression (1)}$$

where L is the spacing between the printing position and the cutting position on the tape 30, and M is the margin set at the leading end of the tape, as described above.

The subsequent tape cut positions C1, C2, . . . , Cn for the respective document data are calculated as follows:

A printing length of a character string Dn for an $n^{th}$ document sectioned by cut data instruction data C is calculated in accordance with Expression (2):

$$Dn=Sn\times APn\times(A-1) \qquad \text{Expression (2)}$$

where A is the number of characters of a character string contained in the $n^{th}$ document sectioned by the cut instruction data C, Sn is the size of characters whose form is set, and Pn is a character spacing.

A tape cut position Cn for the $n^{th}$ document is calculated in accordance with the following expression (3):

$$Cn=Dn+2Mn+Cn-1 \qquad \text{Expression (3)}$$

where Mn is a margin set at each of the leading and trailing ends of the $n^{th}$ document, and Cn−1 is the cut position on the tape for the preceding document.

The tape cut position Cn corresponds to an overall printing length En which ranges from the initial print position to the position at which the printing of the $n^{th}$ document is terminated.

The step count memory 42*i* stores data on the carrying step count X for the tape 30 ranging from the print start position of the whole document data contained in the print data to its print end depending on the overall tape print length En.

The step counter 42*j* counts the number of driving steps Z of the step motor 48 which carries the tape 30 stepwise, stating with the commencement of the printing operation.

Figure 7:
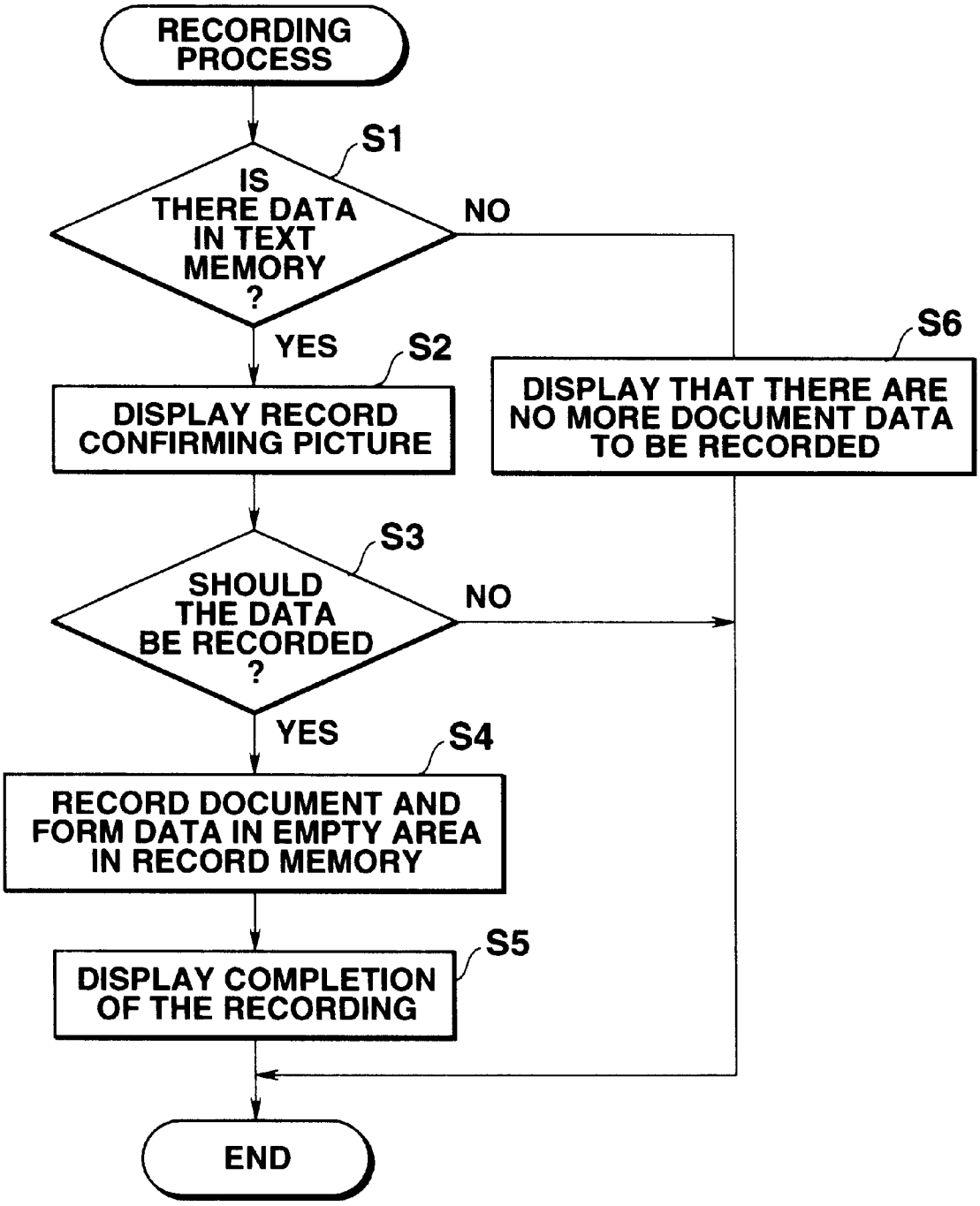
FIG. 7 is a flow chart of an input document recording process performed by the tape printer.

When the record key 12*d* is operated in a state where the document data of a character string input by the character input keys 12*a* is stored in the text memory 42*a,* a recording process for the input document data in FIG. 7 is started up.

Figure 10:
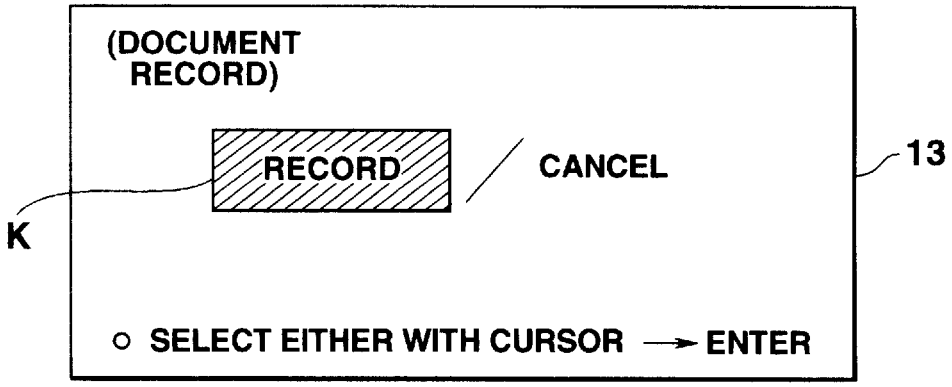
FIG. 10 illustrates a document record confirming picture involved in the recording process preformed by the tape printer.

In this process, first, it is determined whether document data is stored in the text memory 42*a.* If so, a document record confirming picture is displayed on the display unit 13 which confirms from the user whether the document data in the text memory 42*a* should be recorded, as shown in FIG. 10 (step S1→S2).

When the user operates the cursor keys 12*c* to set the cursor K to an item "record" and then operates the enter key 12*e* in a state where the document record confirming picture is displayed, the document data stored in the text memory 42*a* and the form data set for the document data stored in the form memory 42*c* are transferred to and stored in empty areas of the recorded document memory 42*b* (FIG. 6) (step S3→S4). This causes the display unit 13 to display a message indicating that the input document data has been recorded (step S5).

When it is determined at step S1 that no document data is stored in the text memory 42*a,* a message informing the user that there is no recorded document is displayed on display unit 13 (step S1→S6).

When an item "cancel" is selected on the document record confirming picture displayed on the display unit 13 (FIG. 10) at step S2, this recording process is terminated without recording the document data in the text memory 42*a* (step S3→END).

When the read key 12*s* is operated to print together on the tape any plurality of document data selected from a plurality of document data recorded along with a corresponding plurality of form data in the recorded document memory 42*b,* as shown in FIG. 6, a reading process for the selected plurality of document data is started in FIG. 8.

Figure 11:
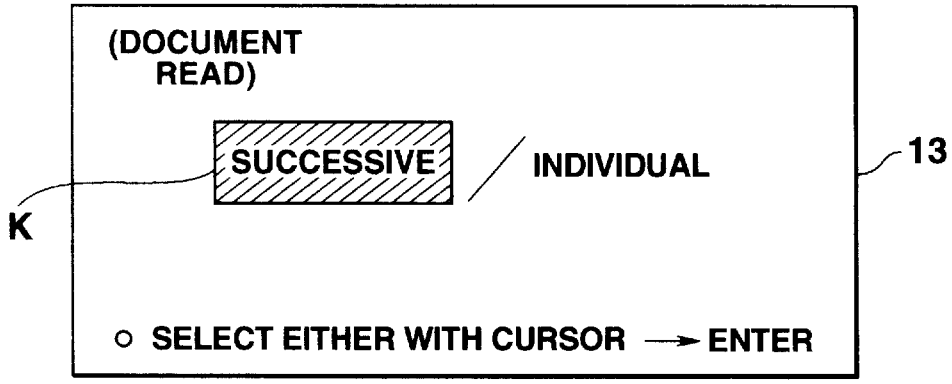
FIG. 11 illustrates a successive or individual reading selecting picture involved in the reading process preformed by the tape printer.

As shown in FIG. 11, in this reading process, a picture which causes the user to select either successive or individual reading of all or a particular one of the plurality of document data, stored in the recorded document memory 42*b,* is displayed on the display unit 13 (step A1).

Figure 12:
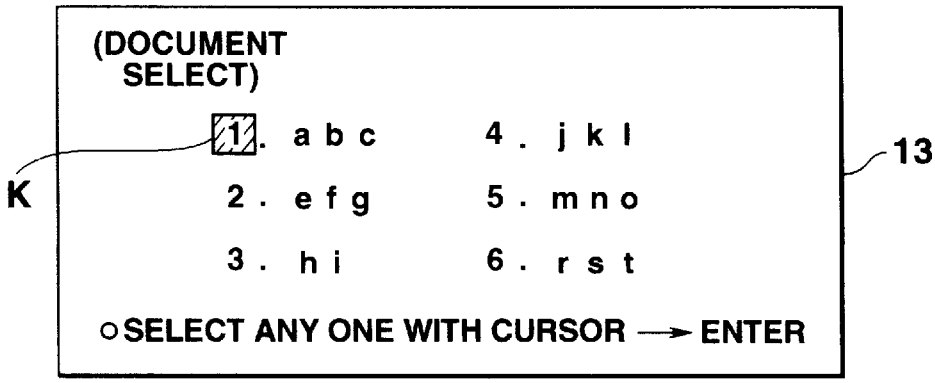
FIG. 12 illustrates a document selecting picture involved in the reading process preformed by the tape printer.

When the user operates the cursor keys 12*c* to select the successive reading and then the enter key 12*e* in a state where that select picture is displayed, a document data select picture on which the first three characters of the respective document data recorded in the recorded document memory 42*b* are extracted and arranged is displayed on the display unit 13, as shown in FIG. 12 (step A2→A3).

When any particular document data is selected by the cursor keys 12*c* and then the enter key 12*e* is operated in a state where the document data select picture is displayed, it is determined whether character string data is stored in the text memory 42*a.* If so, the character string data remaining in the text memory 42*a* is eliminated (step A4→A5→A6).

In response to this operation, the document data selected at step A4 is read from the recorded document memory 42*b* and transferred to the erased text memory 42*a,* and the select No. of the document data is stored in the select file memory 42*e* (steps A7, A8).

In response to this operation, a picture which urges the user to determine whether successive reading of the recorded document data should continue is displayed on the display unit 13. When the enter key 12*e* is operated in a state where that picture is displayed, the document data select picture is again displayed on which the first three characters of the respective document data recorded in the recorded document memory 42*b* are extracted and arranged, as shown in FIG. 12 (step A9, A10→A11).

When the next document data is selected by the cursor keys 12*c* and the enter key 12*e* is operated in a state where that picture is displayed, cut instruction data C is added to the trailing end of the document data selected on the preceding document data select picture and then stored in the text memory 42*a*. After the cut instruction data C, the next document data selected this time is read out from the recorded document memory 42*b*, transferred to and stored in the text memory 42*a*, and the select No. of the document data is additionally stored in the selected file memory 42*e* (step A12→A13, A14, A15). The document data stored in the text memory 42*a* and the recorded document memory 42*b* take the form of character codes. The cut instruction data C takes the form of a predetermined control code not used in the character codes. The control code has a quantity of data of one character.

After step A15, the picture again appears which urges the user to determine whether successive reading of the recorded document data should continue (step A15→A9).

Figure 13:
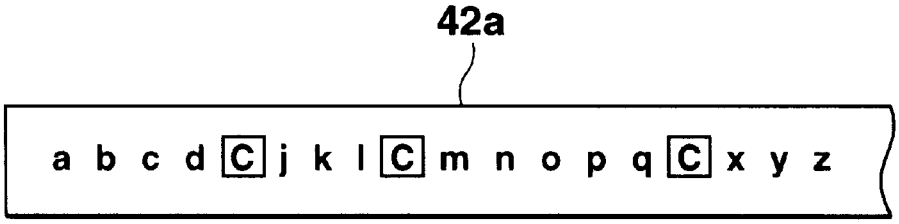
FIG. 13 illustrates addition of a plurality of cut instruction data to a corresponding plurality of document data read into a text memory of the RAM involved in the reading process performed by the tape printer.

Then, when the steps A9–A15 are repeated to perform the successive reading of the plurality of recorded document data, the sequentially selected and read plurality of document data, for example, with corresponding cut instruction data C0, C1, C2, . . . , Cn at their trailing ends are stored in the text memory 42*a*, as shown in FIG. 13.

When an item "cancel" is selected and the enter key 12*e* is operated in a state where a picture is displayed which requires the user to determine whether a further plurality of recorded document data should be successively read, for example, after a fourth document data "xyz" is selectively read, as shown in FIG. 13, the reading process for the plurality of recorded document data is terminated (step A10→END).

When the item "individual" is selected and displayed in an inverted manner by operating the cursor keys 12*c* and the enter key 12*e* is operated at step A1 in a state where the picture where the successive/individual reading should be selected is displayed, data on any one recorded document is read out and stored in the text memory 42*a* (step A2→A16–A21).

Figure 9:
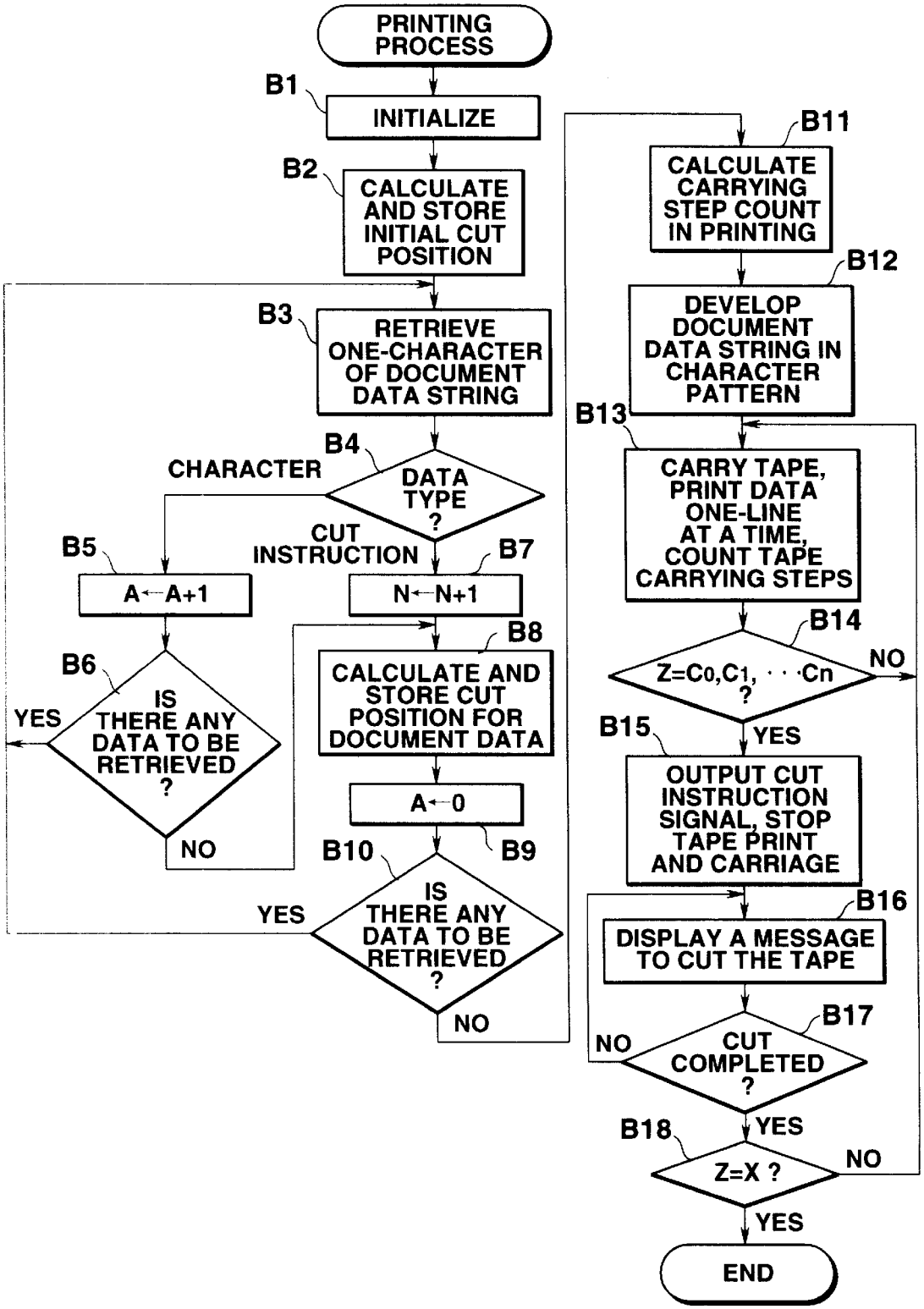
FIG. 9 is a flow chart of a document data printing process performed by the tape printer.

When the print key 12*g* is operated in a state where the plurality of document data are successively read and stored in the text memory 42*a* with cut instruction data C added between the respective ones of the plurality of document data, as shown in FIG. 13, a printing process for the read plurality of document data is started, as shown in FIG. 9.

In this printing process, the character count A in the character counter 42*f*, the cut count N in the cut counter 42*g*, the cut position data Cn in the cut position memory 42*h*, the print carrying step count X in the step count memory 42*i*, and the print drive step count Z in the step counter 42*j* of the RAM 42 are all cleared to zero for initialing purposes (step B1).

In response to this operation, a first cut position C0 for the tape 30 calculated in accordance with the Expression (1) on the basis of the gap L between the printing head and the cutter, and the leading and trailing margins M selected in the form set for the first-document data read into the text memory 42*a*, and then stored in the cut position memory 42*h* (step B2).

In response to this operation, as shown in FIG. 13, a document data string of the plurality of document data read into the text memory 42*a* is retrieved one character at a time, starting with its head, and it is determined whether the retrieved data is character data which compose a part of the document data or cut instruction data C added to the trailing end of the document data (steps B3, B4).

When the character is retrieved, the character count A in the character counter 42*f* is counted up. When there is data to be retrieved next in the text memory 42*a*, the control returns to step B3, where the next data is retrieved (step B4→B5, B6→B3).

Thereafter, when, for example, cut instruction data C added to the trailing end of the first document data is retrieved among the document data string read into the text memory 42*a*, the cut instruction data count N in the cut counter 42*g* is counted up. A tape cut position C1 on the tape where the tape is cut due to termination of the printing of the first document data is calculated in accordance with the Expressions (2) and (3) on the basis of the form set data S1, P1 and M1 for the appropriate document data, the character count A1 in the character counter 42*f*, and the preceding tape cut position C0 stored in the cut position memory 42*h*, and then stored in the cut position memory 42*h* (steps B3, B4→B7, B8).

That is, after the printing length D1 of the character string of the first document data is calculated in accordance with the Expression (2), the tape cut position C1 for the first document is calculated in accordance with the Expression (3) on the basis of the print length D1, and then stored in the cut position memory 42*h* (step S8).

In response to this operation, the character count A of the first document in the character counter 42*f* is cleared to zero. When there are in the text memory 42*a* subsequent document data to be read, the control returns again to step B3 where the retrieving/type determining process and subsequent processes for the subsequent document data string are performed repeatedly (steps B9, B10→B3).

More particularly, the respective steps B3–B10 are repeated on the subsequent document data, so that when the respective document data of the document data string read into the text memory 42*a* are printed sequentially on the tape, the cut positions C1, C2, C3, . . . for the first, second, third, . . . documents are sequentially calculated after the head cut position C0, and then stored in the cut position memory 42*h*. When the last one of the character data which compose the last document data of the document data string stored in the text memory 42*a* is retrieved (steps B3, B4→B5), it is determined that there is no more data to be retrieved, and a cut position Cn for the $n^{th}$ document is calculated and then stored (step B6→B8). At this time, it is determined at step B10 that there is no more document data string to be retrieved. The carrying step count X for the tape 30 ranging from the commencement of printing of the whole document to its end is calculated depending on the overall tape print length En corresponding to the last tape cut position Cn, and then stored in the step count memory 42*i* (step B10→B11).

In response to this operation, all the document data of document data string read into the text memory 42*a* are developed and then stored in the print data memory 42*d* as printing data of font patterns of respective characters read from the print character generator 44 (step B12).

In response to this operation, the step motor 48 is driven to carry the tape 30, and the print data developed in the print data memory 42*d* are transferred one line at a time to the thermal head 18 and then printed on the tape. The number of driving steps of the step motor 48 is counted by the step counter 42*j* (B13).

In the course of such printing, when the number of tape driving steps Z of the step motor 48 counted by the step counter 42*j* from the commencement of the carriage of the tape 30 is determined as matching the head tape cut position C0 stored in the cut position memory 42*h,* the CPU 40 outputs a tape cut instruction signal to the head driver 46 and the step motor driver 47, so that the printing operation of the thermal head 18 and the carriage of the tape 30 are stopped temporarily (step B14→B15).

In response to the output of the tape cut instruction signal, a message which urges the user to cut the tape 30 away (for example, "Please cut the tape away with the lever!") is displayed on the display unit 13 (step B16).

When it is then determined that the tape cutting has been completed, it is determined whether the number of driving steps Z of the step motor 48 from the commencement of carriage of the tape 30 has matched the carrying step count X of the tape 30 stored in the step count memory 42*i,* ranging from the commencement of printing of the whole read document data to its end (step B17→B18). The completion of the tape cut is determined by the fact that the user has operated the cutter operating lever 16*a* and then the enter key 12*e*. In order to sense the cutter operation, a sensor such as a micro switch may be provided on the cutter mechanism 32. For example, in FIG. 3, the rotating disk 37 may have an actuator which abuts on the micro switch to turn on the same when the movable blade 34 moves to a position where it cooperates with the fixed blade 33 to cut the tape. Then, when the micro switch is turned off as a result that the movable blade 34 and the disk 37 have returned to their respective original positions, it may be determined that the tape cutting is completed.

When the determination at step B14 is NO, the printing continues (step B14→B13).

When it is determined in the course of printing that the number of driving steps Z of the stepping motor 48 counted by the step counter 42*j* from the commencement of carriage of the tape 30 matches the next tape-cut position C1 stored in the cut position memory 42*h,* the CPU 40 again outputs a tape cut instruction signal to the head driver 46 and the step motor driver 47 to thereby stop the printing operation of the thermal head 18 and the carriage of the tape 30 again (step B14→B15).

In response to the output of the tape cut instruction signal, a message which urges the user to cut the tape 30 away (for example, "Please cut the tape away with the lever!" or "After the tape is cut away with the lever, please operate the enter key!") is displayed on the display unit 13 (step B16).

Then, when it is determined that the first printed document data with a trailing margin has been cut away, it is determined that the number of driving steps Z of the step motor 48 counted from the commencement of carriage of the tape 30 by the step counter 42*j* has not yet matched the whole number of carrying steps X of the tape 30, ranging from the commencement of printing of the whole read document data stored in the step count memory 42*i* to its end, and the printing continues (step B17→B18→B13, B14→B13).

Figure 14:
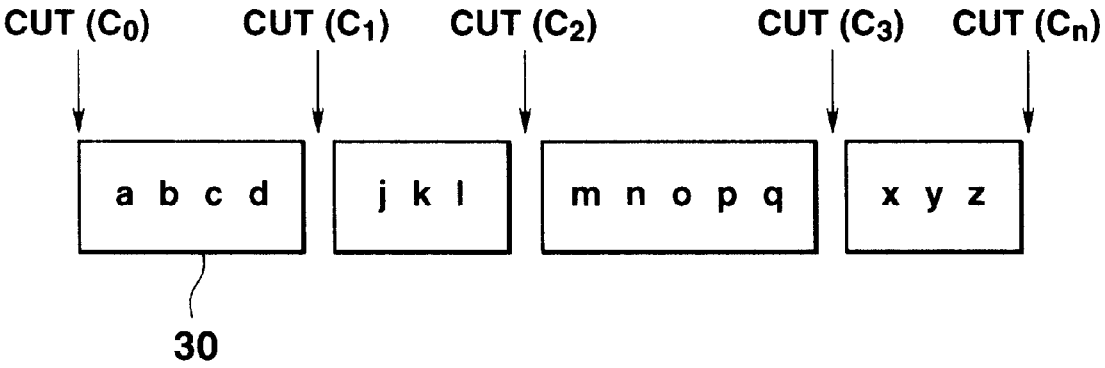
FIG. 14 illustrates a plurality of document data successively printed on a tape and cut tape portions involved in the printing process performed by the tape printer.

Thereafter, the steps B13–B18 are repeated so that, each time the number of motor driving steps Z sequentially matches a respective one of the tape cut positions C2, C3, . . . stored in the cut position memory 42*h,* a temporary stoppage of the printing and carrying operations and cutting operation of the printed tape portions for the respective documents are repeated successively to thereby produce corresponding labels, as shown in FIG. 14.

When it is determined that the number of motor driving steps Z matches the last tape cut position Cn stored in the cut position memory 42*h,* the tape printing and carrying operations are stopped and a message which requests the user to cut the tape away is displayed (step B14→B15, B16). When it is determined that the last printed document data with its trailing margin has been cut away, it is then determined that the number of motor driving steps Z counted by the step counter 42*j* from the commencement of carriage of the tape 30 has matched the whole carrying step count X of the tape 30 ranging from the commencement of printing of the whole read document data stored in the step count memory 42*i* to its end. Thus, successive printing and cutting operations of the plurality of document data are terminated (step B17→B18→END).

Thus, according to the present tape printer, when desired document data are selected and read from among the plurality of document data recorded in the recorded document memory 42*b,* they are sequentially transferred to the text memory 42*a* where they are combined as document data string, cut instruction data C is added between the respective document data, the corresponding printing lengths D1, D2, . . . , Dn of the tape 30 are calculated for the respective document data sectioned by the cut instruction data C, and the tape cut positions C0, C1, C2, . . . , Cn are calculated and then stored in the cut position memory 42*h*. When the document data string developed and stored in the printing data memory 42*d* from the text memory 42*a* are printed by controlling the print driver 46 and the step motor driver 47, a cut instruction signal is output, the tape cut message is displayed, and the tape 30 is cut, each time the number of motor driving steps Z for the tape carriage counted by the step counter 42*j* matches a respective one of the cut positions C0, C1, C2, . . . , Cn stored in the cut position memory 42*h*. In summary, any plurality of document data read from the recorded document memory 42*b* are successively printed while the printed tape portions for the respective document data are being cut away successively.

Thus, when an recorded plurality of document data is printed, it is unnecessary to perform a troublesome operation of repeating the reading and printing of the plurality of documents one at a time as in the conventional tape printer. The printing time is thus reduced. In addition, it is unnecessary to cut the tape end away wastefully to ensure a margin each time the document data is printed, so that no tape is wasted.

As described above, when in the embodiment any plurality of document data stored in the recorded document memory 42*b* are sequentially selected, read, synthesized in the text memory 42*a* in the recorded document reading process of FIG. 8, cut instruction data C is illustrated as being added between the respective ones of the plurality of document data. Alternatively, cut instruction data C may be added beforehand to a respective one of the trailing ends of the respective recorded document data when the document data input and stored in the test memory 42*a* are transferred to and recorded in the recorded document memory 42*b,* as shown in FIG. 15, in the input document recording process of FIG. 7. In the recorded document reading process, the document data to which the cut instruction data C is added may be selectively read, combined and stored in the text memory 42*a*.

FIG. 15 shows the contents of data stored in the recorded document memory 42*b* provided in the RAM 42 in a document recording process as another embodiment.

While in the earlier embodiment the tape cutter mechanism 32 is illustrated as the manual cutting mechanism in which the movable blade 34 operated by the cutter operating lever 16*a* cooperates with the fixed blade 33 to cut the tape, the cutting mechanism may be an automatic cutting mechanism in which the movable blade 34 is turned toward the fixed blade 33 by a motor operated in accordance with a tape cut signal output from the CPU 40 when the tape cut position Cn is detected.

Figure 16:
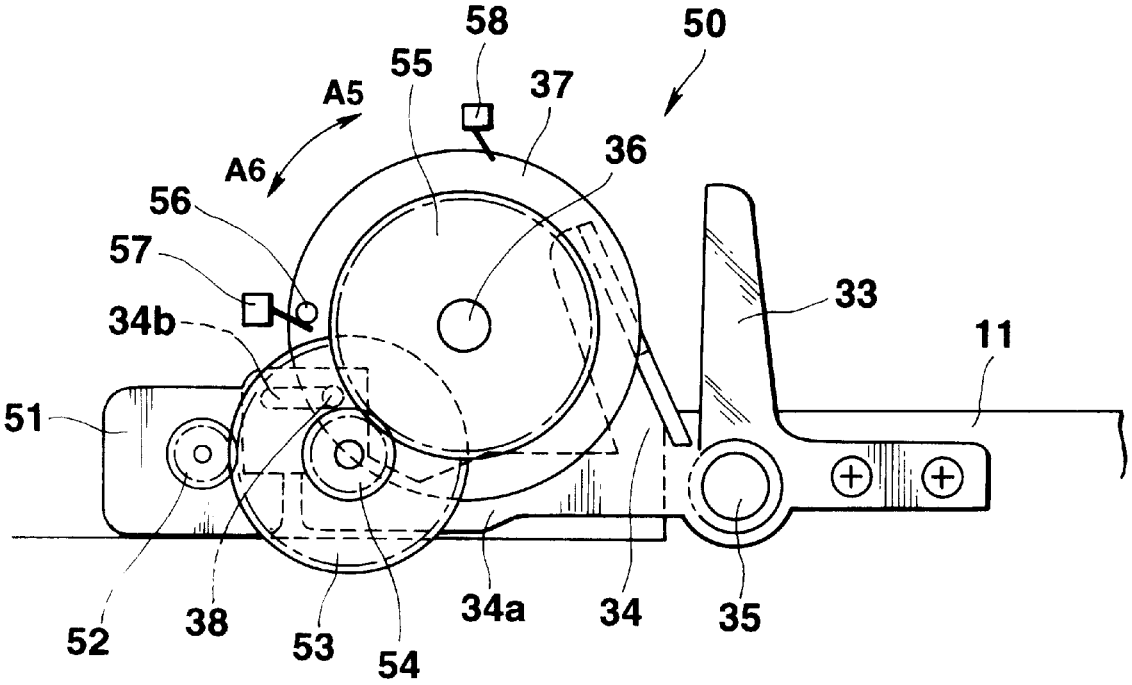
FIG. 16 illustrates another embodiment of the cutter mechanism.

FIG. 16 illustrates this automatic cutting mechanism 50. As in FIG. 3, the cutter mechanism includes a fixed blade 33, a movable blade 34 having an arm 34*a,* and a rotating disk 37 with a pin 38 provided on the rotating disk 37 being engaged in a slot 34*b* in the arm 34*a.* The cutter mechanism 50 includes a drive source of a DC motor 51 whose toque is transmitted via first, second and third intermediate gears 53, 54 and 55 to the rotating disk 37 provided on the same shaft 36 as the third intermediate gear 55 to rotate the rotating disk 37.

A switch actuator 56 is provided at a predetermined position on the rotating disk 37 so that the switch actuator 56 operates two micro switches 57 and 58 which sense the position of the movable blade 34 when the cutter mechanism 50 is operated. The micro switches 57 and 58 sense the initial position and cutting position, respectively, of the movable blade 34 to control the drive of the DC motor 51.

Figure 17:
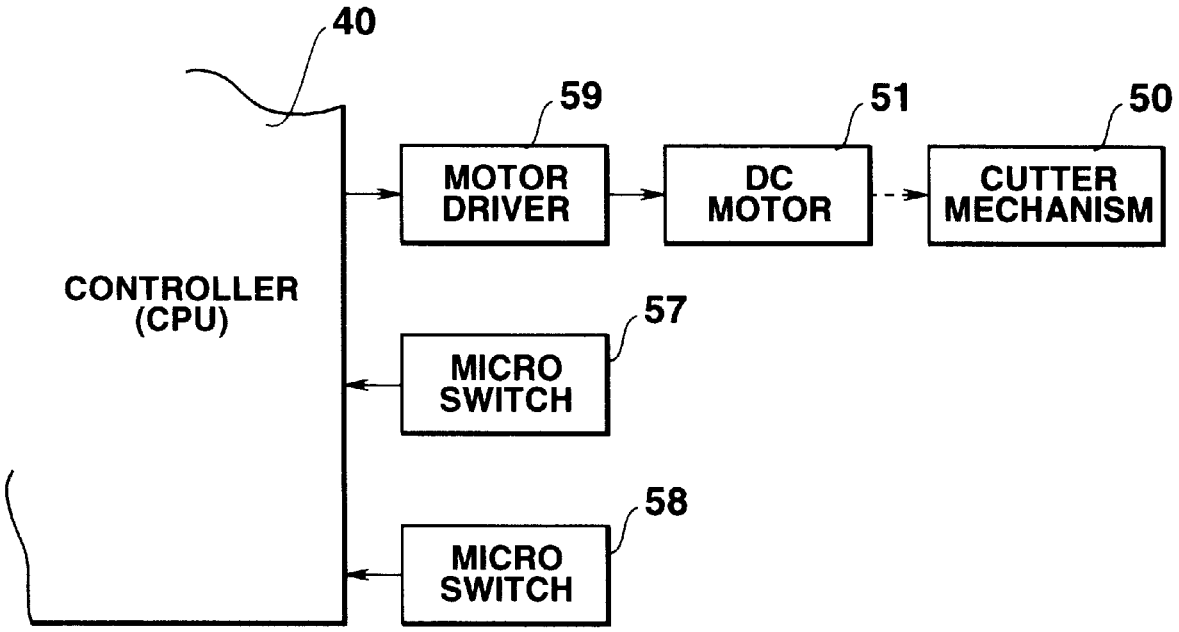
FIG. 17 is a block diagram of an electronic circuit for the cutter mechanism of FIG. 16.

FIG. 17 is a block diagram of an electric circuit added to the block diagram of FIG. 4 in connection with the FIG. 16 cutter mechanism 50. As shown in FIG. 17, the controller 40 is connected to a motor driver 59 which drives the DC motor 51, and also to the micro switches 57 and 58.

In the tape printing process, when a cut instruction signal is output from the controller 40 and it is confirmed that the micro switch 57 is on or that the movable blade 34 is at its initial position, the DC motor 51 is driven by the motor driver 59 to rotate the rotating disk 55 in the direction of an arrow A5. This turns the movable blade 34 against the fixed blade 33. When the movable blade 34 arrives at a position where the cutting of the tape is completed, the micro switch 58 is operated by the switch actuator 56 to be turned on. This reverses the rotation of the DC motor 51 via the motor driver 59, which causes the rotating disk 37 to rotate toward its initial position and also causes the movable blade 34 to move away from the fixed blade 33. When the movable blade 34 arrives at its initial position, the micro switch 57 is operated by the switch actuator 56 to be turned on. By such operation of the micro switches 57 and 58, the completion of the series operations of the cutter mechanism 50 for cutting purpose is determined.

It is to be noted that when the cutter mechanism 50 which is driven by the motor is employed, a message such as is displayed at step B16 of FIG. 9 is not displayed.

What is claimed is:

1. A tape printer comprising:

input means for inputting document data of a character string;

storage means having an area for recording a plurality of document data of a character string input by said input means;

recording means for recording in the area of said storage means the plurality of document data input by said input means;

printing means for printing lengthwise on a tape as a printing medium a plurality of documents corresponding to the plurality of document data recorded in the area of said storage means by said recording means;

cutting means for cutting the tape;

carrying means for carrying the tape to said printing means and said cutting means;

reading means for reading a desired plurality of document data from among the plurality of document data recorded in the area of said storage means;

data combining means for combining into a document data string the desired plurality of document data read by said reading means;

cut instruction data adding means for adding cut instruction data, which instructs cutting of the tape, between the respective document data of a desired plurality combined by said data combining means to section the respective document data;

calculating means for calculating the respective printing lengths of the tape for the respective document data of the document data string sectioned by said cut instruction data to obtain the corresponding tape cutting positions; and control means for controlling said printing means and carrying means to print on the tape a document string corresponding to the document data string to which the desired plurality of document data are combined by said data combining means, during carriage of the tape, and to discontinue the printing of the document data on the tape and the carriage of the tape each time the cutting position of the tape calculated by said calculating means is carried to the position of said cutting means, and to output to said cutting means a cut instruction signal to cut the tape.

2. The tape printer according to claim 1, wherein said cutting means comprises:

a cutting blade for cutting the tape; and a manually operated mechanism by which a user manually operates said cutting blade to cut the tape.

3. The tape printer according to claim 1, wherein said cutting means comprises:

a cutting mechanism having a cutting blade for cutting the tape; and drive means for operating said cutting mechanism.

4. The tape printer according to claim 1, wherein said calculating means comprises means for calculating the printing length of the document data on the basis of a printing length of a character string which composes the document data, and a margin provided at each of a leading and trailing end of the character string.

5. A tape printer comprising:

input means for inputting document data of a character string;

storage means having an area for recording a plurality of document data of a character string input by said input means;

recording means for recording in the area of said storage means the plurality of document data input by said input means;

printing means for printing lengthwise on a tape as a printing medium a plurality of documents corresponding to the plurality of document data recorded in the area of said storage means by said recording means;

cutting means for cutting the tape;

carrying means for carrying the tape to said printing means and said cutting means;

cut instruction data adding means for adding cut instruction data, which instructs cutting of the tape, to respective trailing ends of the plurality of document data input by said input means to section the respective document data when said recording means records the input plurality of document data in the area of said storage means;

reading means for reading a desired plurality of document data from among the plurality of document data recorded in the area of said storage means along with the corresponding plurality of cut instruction data added by said cut instruction data adding means;

data combining means for combining through the cut instruction data the desired plurality of document data read by said reading means so as to produce a document data string;

calculating means for calculating the respective printing lengths of the tape for the corresponding document data of the document data string sectioned by said respective cut instruction data to obtain the corresponding tape cutting positions; and control means for controlling said printing means and carrying means to print on the tape a document string corresponding to the document data string produced by said data combining means during carriage of the tape, and to discontinue the printing of the document data on the tape and the carriage of the tape each time the cutting position of the tape calculated by said calculating means is carried to the position of said cutting means to output to said cutting means a cut instruction signal to cut the tape.

6. The tape printer according to claim 5, wherein said cutting means comprises a cutting blade for cutting the tape and a manually operated mechanism by which a user manually operates said cutting blade to cut the tape.

7. The tape printer according to claim 5, wherein said cutting means comprises a cutting mechanism having a cutting blade for cutting the tape and drive means for operating said cutting mechanism.

8. The tape printer according to claim 5, wherein said calculating means comprises means for calculating the printing length of the document data on the basis of a printing length of a character string which composes the document data, and a margin provided at each of a leading and a trailing end of the character string.

9. The tape printer according to claim 1, further comprising:

display means for displaying information necessary for the printing; and display control means for causing said display means to display a message which urges the user to operate said cutting means on a basis of the cut instruction signal output by said control means.

10. The tape printer according to claim 1, further comprising:

cut control means for driving said drive means to operate said cutting mechanism on the basis of the cut instruction signal output by said control means.

11. The tape printer according to claim 5, further comprising:

display means for displaying information necessary for the printing; and display control means for causing said display means to display a message which urges the user to operate said cutting means on the basis of the cut instruction signal output by said control means.

12. The tape printer according to claim 5, further comprising:

cut control means for driving said drive means to operate said cutting mechanism on the basis of the cut instruction signal output by said control means.

* * * * *